US005732719A

United States Patent [19]

Godbout

[11] Patent Number: 5,732,719

[45] Date of Patent: Mar. 31, 1998

[54] FLEXIBLE MANICURE AND PEDICURE IMPLEMENT

[76] Inventor: Ginette Godbout, 3015 Noorduyn, Ville St-Laurent Quebec, Canada, H4R 1a1

[21] Appl. No.: 380,009

[22] Filed: Jan. 27, 1995

[51] Int. Cl.[6] ..... A45D 29/04

[52] U.S. Cl. ..... 132/76.4

[58] Field of Search ..... 132/73, 76.4, 76.5; 451/526, 532, 530, 533, 539, 523, 524, 525, 921

[56] References Cited

U.S. PATENT DOCUMENTS

| | | | |
|---|---|---|---|
| 2,308,624 | 1/1943 | Pouech | 132/76.4 |
| 2,450,207 | 9/1948 | Silverman | 132/76.4 |
| 3,623,282 | 11/1971 | Norris, III | 451/523 |
| 3,894,673 | 7/1975 | Lowder et al. . | |
| 3,956,858 | 5/1976 | Catlin et al. | 451/525 |
| 4,018,576 | 4/1977 | Lowder et al. . | |
| 4,369,098 | 1/1983 | Van Roeyen . | |
| 4,927,483 | 5/1990 | Bray | 132/76.4 |
| 5,109,637 | 5/1992 | Calafut | 451/533 |

*Primary Examiner*—Todd E. Manahan
*Attorney, Agent, or Firm*—Marvin S. Towsend

[57] ABSTRACT

A manicure and pedicure implement for filing natural and false nails and removal of calluses. The implement is a flat flexible strip of fiberglass with thicknesses ranging from 0.020 inches to 0.035 inches. A single layer of uniform diamond particles is embedded on at least a surface of the substrate and the grit ranges from 50 to 500 mesh.

7 Claims, 2 Drawing Sheets

Fig. 5
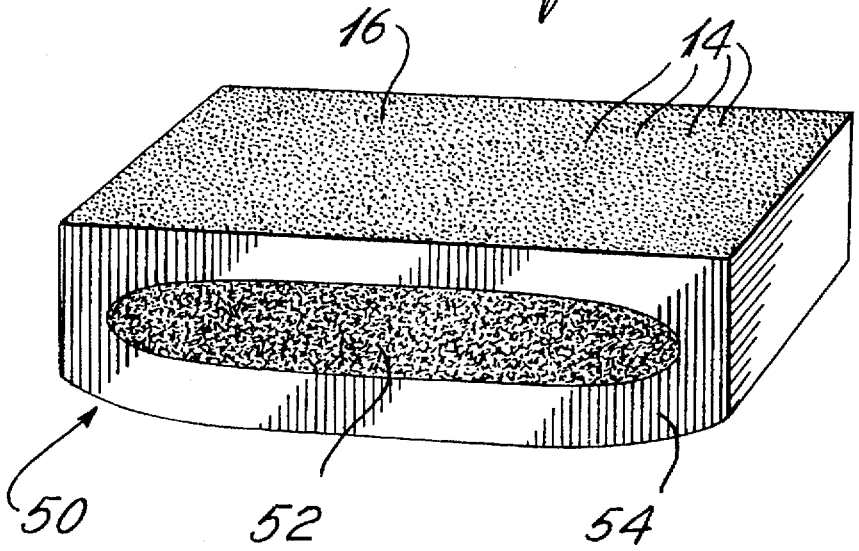
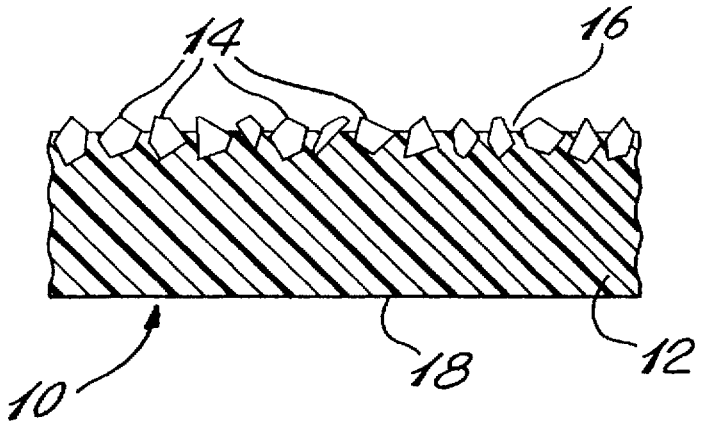
Fig. 4

FLEXIBLE MANICURE AND PEDICURE IMPLEMENT

BACKGROUND OF THE INVENTION

1. Field of the Invention

My invention relates to beauty care instruments, and more particularly, to instruments relating to diamond abrasive techniques for manicure, pedicure, or false nail operations, that is, the maintenance of finger and toe nails and the skin of the hands and feet.

2. Description of the Prior Art

Nail files generally include a steel substrate on which particles of an abrasive material are retained by an adhesive. Diamond particles have been suggested as abrasive particles for nail files as described in U.S. Pat. No. 2,308,624, Pouech, 1943. In the Pouech patent, the diamonds are retained on a metal substrate by means of a thermoplastic adhesive.

U.S. Pat. No. 4,369,098, Van Roeyen, 1983, suggests that abrasive particles can be held on a steel strip substrate by electroplating a metal layer over the particles, leaving a thick coating in the valleys and a thin coating over the tips. Although the retention of the abrasive particles is enhanced by the latter procedure, the disadvantages of a file with the tips of the particles being covered by a thin coat of nickel that must be worn down is quite evident.

The use of steel strips as a substrate is also considered a disadvantage because it is difficult to obtain a sufficiently flexible file for certain manicure uses. Furthermore, steel or other metal substrates are susceptible to corrosion when these instruments are cleaned with sufficiently strong cleaning fluids.

It is noted that the cutting and grinding industry has developed sanding and grinding products that could have applications to instruments of the type mentioned above, such as files and other instruments for the manicure and pedicure field. For instance, flexible belts and disks have been developed on which diamond particles have been electroplated or brazed for sanding stone and other similar products. The substrate suggested for such belts is made of fiberglass. The diamond particles may be brazed on the substrate leaving 70% of the diamond particles exposed. The brazing technique is described in U.S. Pat. Nos. 3,894,673, Lowder et al, 1975, and 4,018,576, Lowder et al, 1977, both assigned to Abrasive Technology, Inc.

SUMMARY OF THE INVENTION

It is an aim of the present invention to provide diamond abrasive instruments for the beauty care industry, particularly manicure, pedicure, and false nail instruments that embody some of the techniques developed for the cutting and grinding industry.

It is a further aim of the present invention to provide beauty care instruments that will include a substrate made of a fiberglass material or A.B.S., P.V.C., polypropylene, polyimide film, Mylar, Nylon, carbon fiber, and Kevlar, having a suitable thickness in relation to the degree of flexibility that is desired in a particular application. The selection of the grit size will also be important in determining the use to which the instrument will be applied.

An instrument for beauty care in accordance with my invention comprises at least a blank substrate made of a material selected from A.B.S., P.V.C., Mylar, fiberglass, carbon fiber, Nylon, Kevlar, polypropylene, and a single layer of diamond particles of uniform grit selected for the required use of the instrument, the diamond particles being retained to the substrate at least on one portion thereof by nickel plating.

More particularly, the substrate is a flat strip of fiberglass material having a thickness which is directly related to the required flexibility of the blank and ranging between 0.020 and 0.125 inches, and the diamond particles are of a uniform grit between 30 to 1200 mesh.

Thus, an instrument for beauty care can be tailored to a particular use. For instance, a nail file of great flexibility and fine grit can be provided for filing, sculpting, and shaping real or false finger or toe nails. On the other hand, an instrument for removing heavy corns and calluses would require a thicker substrate and diamonds of a coarser grit. In other words, it is merely necessary to vary the thickness of the substrate to vary the flexibility of the instrument. On the other hand, a thin substrate of fiberglass having a thickness of approximately 0.010 inches might be placed on a relatively stiffer backing of plastics material.

BRIEF DESCRIPTION OF THE DRAWINGS

Having thus generally described the nature of the invention, reference will now be made to the accompanying drawings, showing by way of illustration, a preferred embodiment thereof, and in which:

FIG. 4 is a cross-section taken through a portion of a detail shown in FIG. 1; and FIG. 5 is a perspective view of a still further embodiment of the present invention.

DESCRIPTION OF THE PREFERRED EMBODIMENTS

Figure 1:
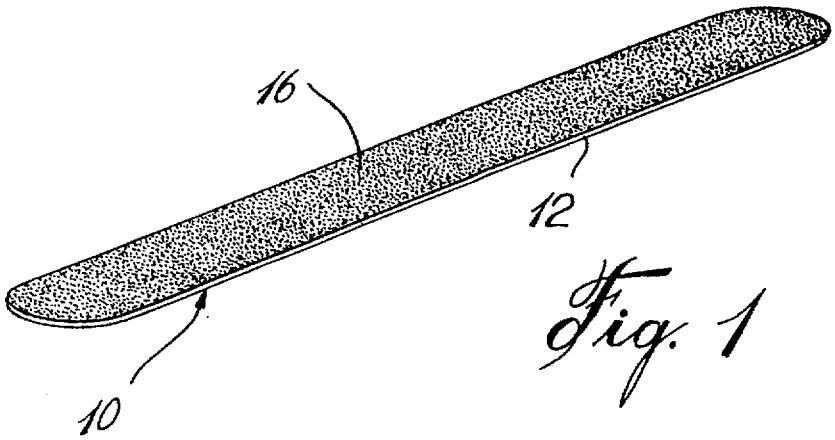
FIG. 1 is a perspective view of a nail file in accordance with the present invention.

Referring now to the drawings, FIGS. 1 and 4 show a typical flexible nail file embodying the present invention. The file 10 is shown as having a substrate 12 with diamond particles 14 on the top surface 16 of the file 10. As can be seen, the file 10 is in the form of an elongated flat strip with diamond particles disposed on only one surface, namely, surface 16. The opposite surface 18, in this embodiment, is smooth. It is contemplated, however, that the surface 18 could have a layer of abrasive diamond particles possibly of a different grit.

In the present embodiment, the substrate 12 is a strip of fiberglass material, and the diamond particles 14 have been electroplated to the top surface thereof. A brazing technique described in U.S. Pat. Nos. 3,894,673 and 4,018,576 could also be used but not on all substrates in view of the heat treatment required. Fiberglass and Kevlar could be suitable substrates for brazing. This brazing technique allows a chemical bond between the diamond particles and the substrate surface 16.

In the embodiment shown in FIGS. 1 and 4, the file 10 has a substrate 12 which is of fiberglass with a thickness that is typically 0.020 inches. This provides great flexibility which is not available from the typical metal file. Diamond particles have been electroplated to the top surface in a single layer, and the grit size of the diamonds is 220 to 600 mesh based on U.S. standard screen mesh size. This would be equivalent to between 74 and 30 microns. Such a flexible, fine grit file would be suitable for filing, shaping, and sculpting real finger nails as well as false nails and toe nails.

In order to file toe nails and false nails as well as removing dry and rough skin on fingers, a less flexible file 10 would be required. A fiberglass substrate 12 has a thickness in the order of 0.030 inches, and the grit size of the diamonds would be between 100 and 120 mesh which is equivalent to 149 to 125 microns.

Figure 2:
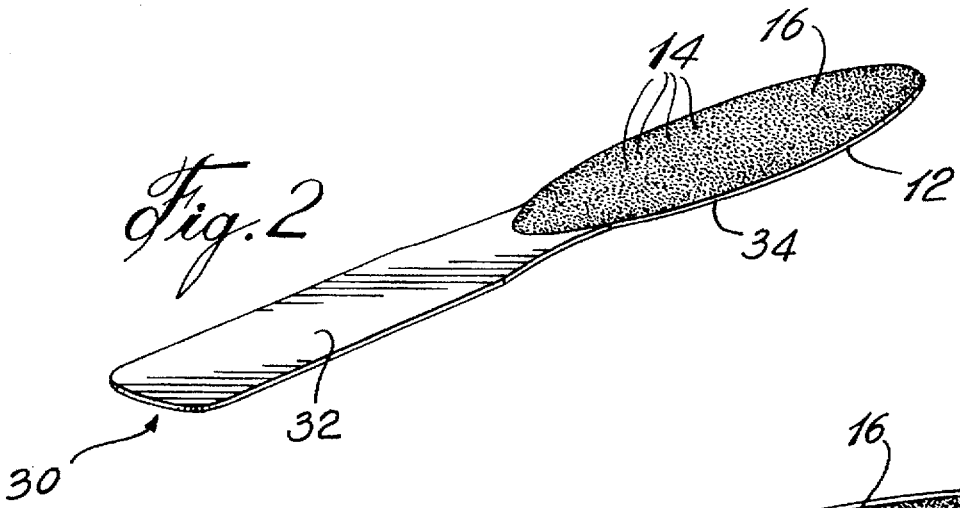
FIG. 2 is a perspective view of a further embodiment of the present invention.

For different applications, different thicknesses of the file and diamond grit would apply. For instance, the embodiment shown in FIG. 2 includes a file 30 with a handle portion 32 and a head portion 34. The substrate 12 forms part of the head 34 while the top surface 16 is provided with the layer of diamond particles 14.

A further embodiment used for filing heavy corns and calluses on one's feet could have a thickness of 0.030 inches with a grit size for the diamonds at approximately 50 mesh.

The substrates with 0.030 inch thickness could qualify as being semi-flexible while a fiberglass substrate having a thickness of 0.059 inches could qualify as being relatively rigid.

Figure 3:
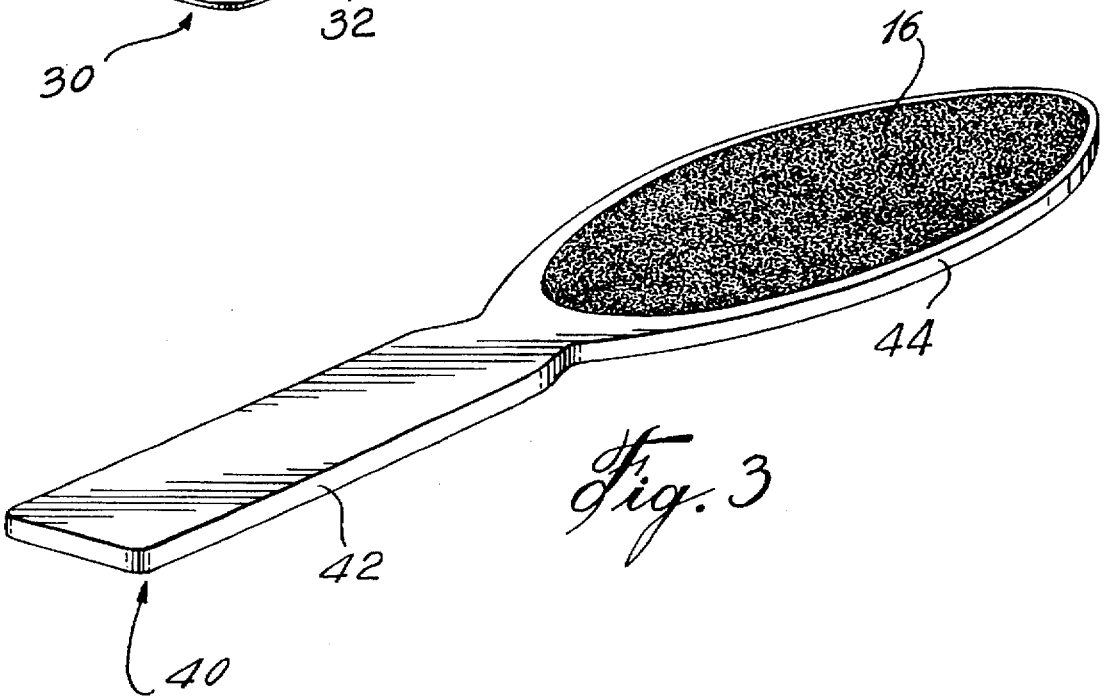
FIG. 3 is a perspective view of a still further embodiment of the present invention.

In the embodiment shown in FIG. 3, the file 40 has a handle 42 and a head 44 with the substrate overlying the head 44. What appears on the head 44 is the top surface 16 of the fiberglass substrate 12. A layer of diamond particles 14 having a grit size of between 70 to 100 mesh has been electroplated on the substrate 12. Such a device could be used for removing dry skin on one's feet.

A further embodiment is shown in FIG. 5, wherein a hand-held pad 50 is illustrated having a foam core 52 and a molded substrate 54 surrounding the foam core. The top surface 16 of this pad 50 is provided with a layer of diamond abrasive particles 14. In this embodiment, a thickness of the substrate between the foam core and the top surface 16 would be approximately 0.050 inches. On the other hand, a thin substrate having a thickness of 0.010 inches could overlay a more rigid backing of plastics material. This hand-held pad 50 might be provided with different uniform layers, one layer at a time, having a grit of anywhere from 30 to 1200 depending on the utility of the pad.

The substrate can be made from any number of materials, including plastics such as P.V.C., A.B.S., polypropylene, polyimide film, Mylar (registered trademark), Nylon (registered trade-mark), composite materials such as fiberglass, G-10, carbon fiber, and carbon and boron. Textile materials made of Kevlar (registered trade-mark) could also be utilized. The advantage of these materials is to provide flexible and semi-flexible strips which can be varied depending on the thickness which is selected and which can be molded to different shapes and sizes. Thus, a combination of different grit size and thicknesses of the substrate will permit any combination of diamond abrasive instrument for different uses in the beauty care industry, including manicure, pedicure, and false nail sectors.

The substrate will also remain hygienic, being washable with antiseptic and non-bacterial solutions without fear of corrosion.

I claim:

1. A manicure and pedicure implement comprising a handle portion and a head portion wherein at least the head portion comprises a substrate made of material with characteristics comparable to fiberglass, having a thickness of substantially between 0.020 and 0.035 inches to provide a flexibility that is directly related to the use as a manicure or pedicure file, and a surface of the substrate is provided with a single layer of diamond particles of uniform grit size selected from substantially between 40 and 500 mesh, wherein the diamond particles are retained to the substrate on at least the head portion thereof by electroplating of a material selected from nickel and nickel alloy whereby the manicure and pedicure implement can have the desired flexibility to apply the head portion of the implement to the nails and surrounding skin of a person.

2. The manicure and pedicure implement as defined in claim 1, wherein the substrate is a flat strip of fiberglass material.

3. The manicure and pedicure implement as defined in claim 2, wherein the substrate has a thickness of 0.020 inches and a uniform grit of between 220 to 500 mesh.

4. The manicure and pedicure implement as defined in claim 2, wherein the substrate is 0.030 inches thick and the diamond particles have a uniform size ranging from 120 mesh to 220 mesh.

5. The manicure and pedicure implement as defined in claim 1, wherein the handle portion and the head portion comprise a uniform substrate where the flexible sheet is an elongated flat strip with the layer of diamond particles extending throughout the surface of the strip.

6. The manicure and pedicure implement as defined in claim 1, wherein the handle portion has a smooth surface.

7. The manicure and pedicure implement as defined in claim 1, wherein the thickness is between 0.022 and 0.032.

* * * * *